US007946317B1

(12) United States Patent
Organ

(10) Patent No.: US 7,946,317 B1
(45) Date of Patent: May 24, 2011

(54) FUNNEL ASSEMBLY

(76) Inventor: Thomas M. Organ, Deweyville, TX (US)

( * ) Notice: Subject to any disclaimer, the term of this patent is extended or adjusted under 35 U.S.C. 154(b) by 329 days.

(21) Appl. No.: 12/241,255

(22) Filed: Sep. 30, 2008

(51) Int. Cl.
*F16N 33/00* (2006.01)
*F01M 11/04* (2006.01)

(52) U.S. Cl. ..... 141/331; 141/86; 141/331 A; 141/340; 184/1.5

(58) Field of Classification Search ..... 141/86, 141/311 A, 331, 332, 340–342; 184/1.5
See application file for complete search history.

(56) References Cited

U.S. PATENT DOCUMENTS 1,668,245 A * 5/1928 McGowan ..... 184/1.5
RE17,613 E * 3/1930 McGowan ..... 141/331
3,967,697 A * 7/1976 Guenther ..... 184/1.5
4,230,002 A * 10/1980 Skidmore ..... 141/331
4,592,448 A * 6/1986 Morris ..... 184/1.5
4,800,933 A * 1/1989 Moore et al. ..... 141/331
5,259,426 A 11/1993 Burleigh et al.
5,819,819 A * 10/1998 Stanley ..... 141/86
5,852,961 A 12/1998 Kotowski
5,960,907 A 10/1999 Chau
5,979,516 A 11/1999 Grant
6,338,357 B1 * 1/2002 Zevgolis ..... 141/86
D554,166 S 10/2007 LaFollette
2003/0106608 A1 * 6/2003 Walter et al. ..... 141/331

* cited by examiner

*Primary Examiner* — Gregory L Huson
*Assistant Examiner* — Nicolas A Arnett

(57) ABSTRACT

A funnel assembly includes a perimeter wall that has a frusto-conical shape and has an upper edge and a lower edge wherein a diameter of an interior bounded by the perimeter wall decreases from the upper edge to the lower edge. Each of the upper and lower edges defines openings into the interior. The perimeter wall has an aperture extending therethrough. A tool is extendable through the aperture to engage a drain bolt of an oil pan. The aperture is spaced from the upper and lower edge.

7 Claims, 3 Drawing Sheets

FUNNEL ASSEMBLY

BACKGROUND OF THE INVENTION

Field of the Invention

The present invention relates to oil changing funnel devices and more particularly pertains to a new oil changing funnel device for allowing a person to engage an oil pan drain plug through the funnel device to prevent oil from spilling outside of the device while also retaining the drain plug.

SUMMARY OF THE INVENTION

The present invention meets the needs presented above by generally comprising a perimeter wall that has a frusto-conical shape and has an upper edge and a lower edge wherein a diameter of an interior bounded by the perimeter wall decreases from the upper edge to the lower edge. Each of the upper and lower edges defines openings into the interior. The perimeter wall has an aperture extending therethrough. A tool is extendable through the aperture to engage a drain bolt of an oil pan. The aperture is spaced from the upper and lower edge.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
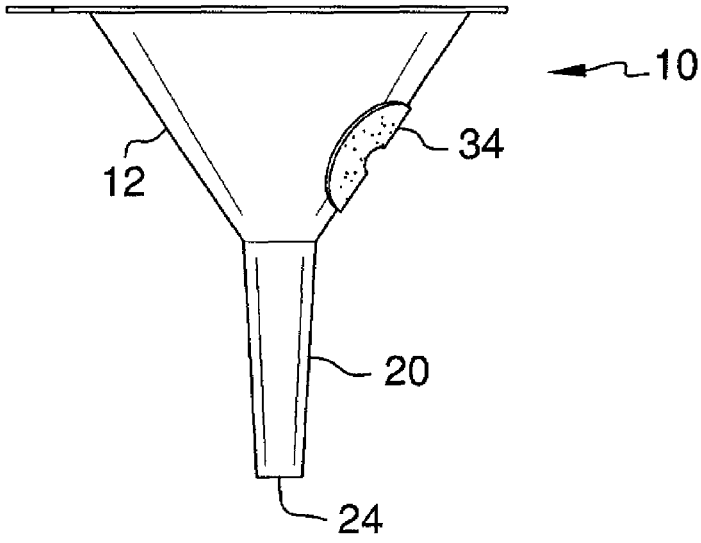
FIG. 1 is a front view of a funnel assembly according to the present invention.
Figure 2:
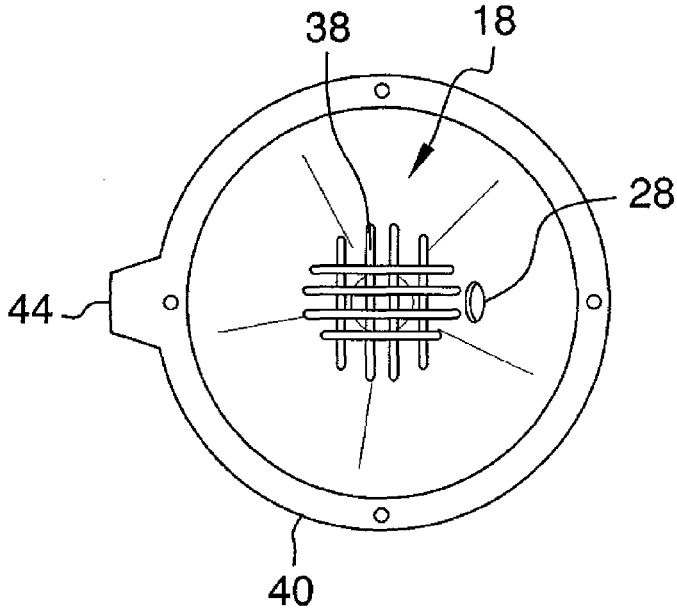
FIG. 2 is a top view of the present invention.
Figure 3:
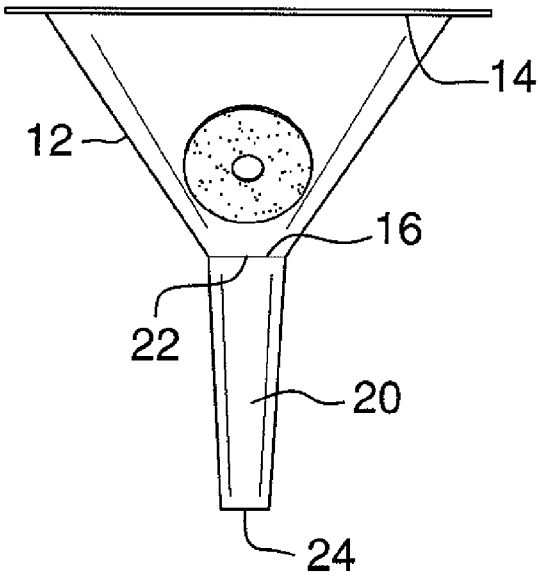
FIG. 3 is a side view of the present invention.
Figure 4:
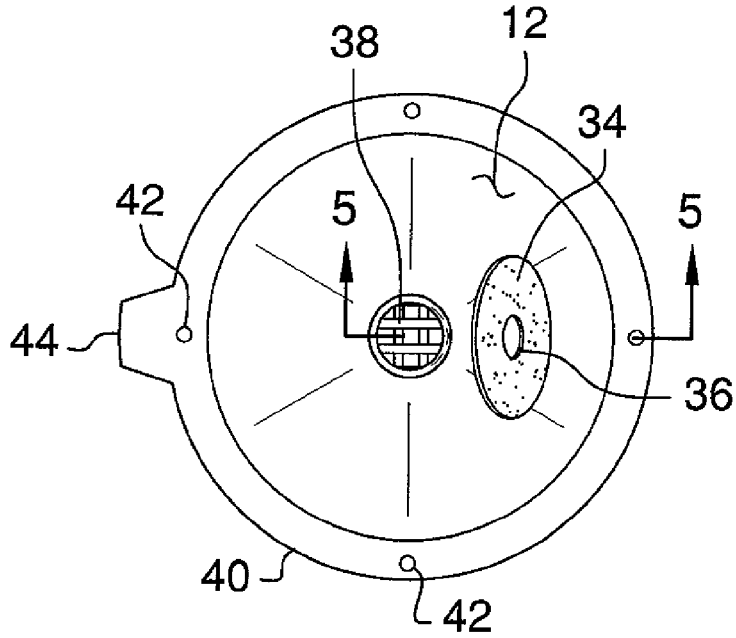
FIG. 4 is a bottom view of the present invention.
Figure 5:
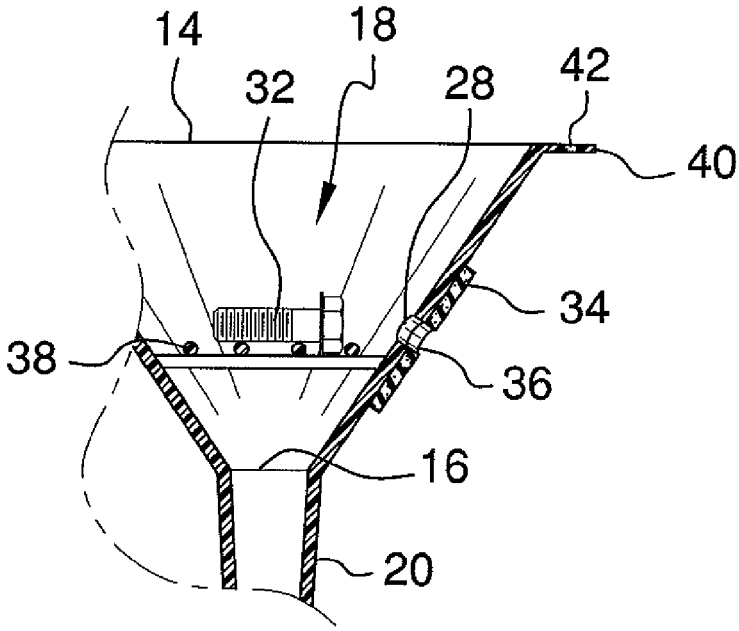
FIG. 5 is a cross-sectional view taken along line 5-5 of FIG. 4 of the present invention.
Figure 6:
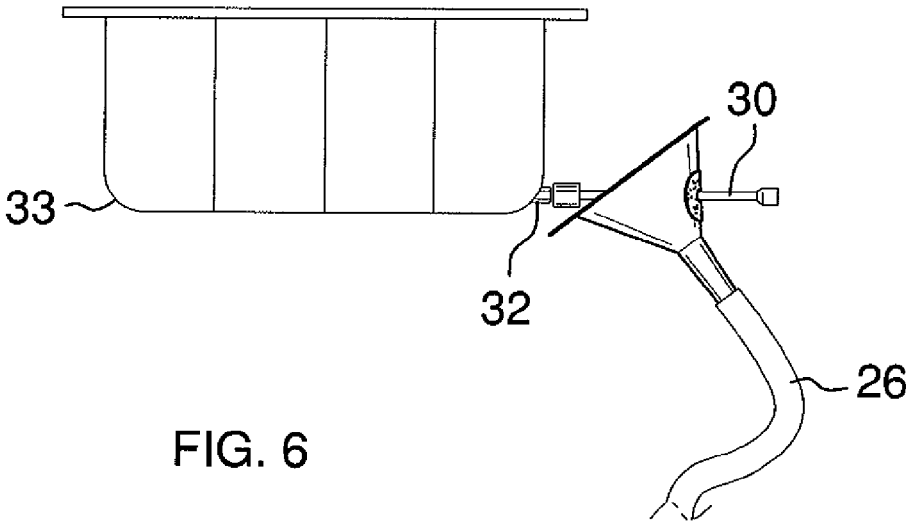
FIG. 6 is a side in-use view of the present invention.

With reference now to the drawings, and in particular to FIGS. 1 through 6 thereof, a new oil changing funnel device embodying the principles and concepts of the present invention and generally designated by the reference numeral 10 will be described.

As best illustrated in FIGS. 1 through 6, the funnel assembly 10 generally comprises a perimeter wall 12 that has a frusto-conical shape and has an upper edge 14 and a lower edge 16 wherein a diameter of an interior 18 bounded by the perimeter wall 12 decreases from the upper edge 14 to the lower edge 16. Each of the upper 14 and lower 16 edges defines openings into the interior 18. A spout 20 is integrally coupled to the lower edge 16 and extends downwardly therefrom. The spout 20 has frusto-conical shape as well from a proximal end 22 to a distal end 24 thereof with respect to the lower edge 16. However, the spout 20 has a higher ration of height change to diameter change with respect to the interior space 18 so that the spout 20 is more elongated and can more easily be fluidly coupled to a drain hose 26.

The perimeter wall 12 has an aperture 28 extending therethrough. A tool 30 is extendable through the aperture 28 to engage a drain bolt 32 of an oil pan 33. The tool 30 may consist of any conventional socket tool for engaging a bolt head. The aperture 28 is spaced from the upper 14 and lower 16 edges.

A gasket 34 is attached to an outer surface of the perimeter wall 12. The gasket 34 has an opening 36 therein aligned with the aperture 28. The gasket 34 forms a seal around the tool 30 when the tool 30 is extended through the aperture 28.

A screen 38 is positioned within the interior 18 and filters fluid flowing inward of the upper edge 14 and outwardly of the lower edge 16 to prevent objects in the fluid from flowing outwardly of the lower edge 16. The screen 38 is positioned between the lower edge 16 and the aperture 28. The screen 38 is a mesh material which, in particular, prevents large objects such as the drain bolt 32 from falling through the lower edge 22.

A peripheral flange 40 is attached to and coextensive with the upper edge 14. The peripheral flange 40 extends outwardly from the upper edge and has a plurality of holes 42 extending therethrough. The holes 42 are spaced from each other and may be used for engaging the peripheral flange 40 with one or more wires to support the assembly 10 where needed. A gripping tab 44 is attached to and extends outwardly from the peripheral flange 40.

In use, the perimeter wall 12, which defines a funnel, is positioned under an oil pan 33 and the tool 30 extended through the aperture 28 to engage the drain plug 32. The drain plug 32 can then be removed without oil from the oil pan 33 spilling onto the mechanic and the drain plug 32 may be captured by the screen 38. The screen 38 is spaced from the lower edge 16 to prevent the drain plug 32 from interfering with the flow the oil. The gasket 34 prevents the oil from spilling through the perimeter wall 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A funnel assembly comprising:

a perimeter wall having a frusto-conical shape and having an upper edge and a lower edge wherein a diameter of an interior bounded by said perimeter wall decreases from said upper edge to said lower edge, each of said upper and lower edges defining openings into the interior, said perimeter wall having an aperture extending therethrough, wherein a tool is extendable through said aperture to engage a drain bolt of an oil pan, said aperture being spaced from said upper and lower edges;

a spout being integrally coupled to said lower edge and extending downwardly therefrom; and said aperture being defined by an inner edge, said inner edge configured such that the tool will be orientated perpendicular to the perimeter wall and said spout angled away from a vertical orientation when the tool is horizontally orientated.

2. The assembly according to claim 1, further including a gasket being attached to an outer surface of said perimeter wall, said gasket having an opening therein aligned with said aperture, said gasket forming a seal around the tool when the tool is extended through said aperture.

3. The assembly according to claim 1, further including a screen being positioned within the interior and filtering fluid flowing inward of said upper edge and outwardly of said lower edge to prevent objects in the fluid from flowing outwardly of said lower edge, said screen being positioned between said lower edge and said aperture.

4. The assembly according to claim 3, further including a peripheral flange being attached to said upper edge and extending outwardly from said from upper edge, said peripheral flange having a plurality of holes extending therethrough, said holes being spaced from each other.

5. The assembly according to claim 1, further including a peripheral flange being attached to said upper edge and extending outwardly from said from upper edge, said peripheral flange having a plurality of holes extending therethrough, said holes being spaced from each other.

6. The assembly according to claim 5, further including a gripping tab being attached to and extending outwardly from said peripheral flange.

7. A funnel assembly comprising:

a perimeter wall having a frusto-conical shape and having an upper edge and a lower edge wherein a diameter of an interior bounded by said perimeter wall decreases from said upper edge to said lower edge, each of said upper and lower edges defining openings into the interior;

a spout being integrally coupled to said lower edge and extending downwardly therefrom;

said perimeter wall having an aperture extending therethrough, wherein a tool is extendable through said aperture to engage a drain bolt of an oil pan, said aperture being spaced from said upper and lower edges, said aperture being defined by an inner edge, said inner edge configured such that the tool will be orientated perpendicular to the perimeter wall and said spout angled away from a vertical orientation when the tool is horizontally orientated;

a gasket being attached to an outer surface of said perimeter wall, said gasket having an opening therein aligned with said aperture, said gasket forming a seal around the tool when the tool is extended through said aperture;

a screen being positioned within the interior and filtering fluid flowing inward of said upper edge and outwardly of said lower edge to prevent objects in the fluid from flowing outwardly of said lower edge, said screen being positioned between said lower edge and said aperture;

a peripheral flange being attached to said upper edge and extending outwardly from said from upper edge, said peripheral flange having a plurality of holes extending therethrough, said holes being spaced from each other; and a gripping tab being attached to and extending outwardly from said peripheral flange.

* * * * *